US012727616B2

(12) United States Patent
Thrash

(10) Patent No.: US 12,727,616 B2
(45) Date of Patent: Sep. 8, 2026

(54) CIGAR HOLDER

(71) Applicant: Victor Thrash, Bellflower, CA (US)

(72) Inventor: Victor Thrash, Bellflower, CA (US)

( * ) Notice: Subject to any disclaimer, the term of this patent is extended or adjusted under 35 U.S.C. 154(b) by 368 days.

(21) Appl. No.: 18/379,080

(22) Filed: Oct. 11, 2023

(65) Prior Publication Data

US 2024/0298701 A1 Sep. 12, 2024

Related U.S. Application Data

(60) Provisional application No. 63/451,593, filed on Mar. 12, 2023.

(51) Int. Cl.
*A24F 13/08* (2006.01)

(52) U.S. Cl.
CPC ..... *A24F 13/08* (2013.01)

(58) Field of Classification Search
None
See application file for complete search history.

(56) References Cited

U.S. PATENT DOCUMENTS 3,756,252 A * 9/1973 Vigorito ..... A24F 13/22 131/257
5,489,075 A * 2/1996 Ible ..... A61J 9/0638 24/339
2009/0032035 A1* 2/2009 Thorpe ..... A24F 13/22 24/457
2009/0183742 A1* 7/2009 Strasheim ..... A24F 13/26 131/248
2011/0253154 A1* 10/2011 Dolciato ..... A24F 13/22 131/260
2013/0146071 A1* 6/2013 Hatcher ..... A24F 13/08 131/260
2020/0224685 A1* 7/2020 Calhoun ..... G03B 17/56
2024/0268454 A1* 8/2024 Hodges ..... A24F 13/22

* cited by examiner

*Primary Examiner* — Philip Y Louie
*Assistant Examiner* — Madeleine P Delacruz
(74) *Attorney, Agent, or Firm* — Mike R Kendrick

(57) ABSTRACT

A cigar holder includes a top jaw assembly, the top jaw assembly including first opening on a first side and a second opening on a second side and a bottom jaw assembly, the bottom jaw assembly including a first opening on a first side and a second opening on a second side; a spring; a spacer element, the spacer element including a hollow center and the spacer element placed inside an opening in a center of a spring and positioned adjacent the first opening and the second opening of the top jaw assembly and positioned adjacent the first opening and the second opening of the bottom jaw assembly; and a rivet, the rivet including a main body, a fixed first end and a detachable second end, the rivet configured to be positioned in the hollow opening of the spacer element.

9 Claims, 8 Drawing Sheets

400

CIGAR HOLDER

RELATED APPLICATIONS

This application claims priority to provisional patent application Ser. No. 63/451,593, filed Mar. 12, 2023, and entitled "Cigar Holder," the entirety of which is incorporated by reference.

BACKGROUND

There are a number of cigar holders on the market today. However, the cigar holders are not adjustable and cannot handle different sizes of cigars.

DETAILED DESCRIPTION

The following detailed description and provides a better understanding of the features and advantages of the inventions described in the present disclosure in accordance with the embodiments disclosed herein. Although the detailed description includes many specific embodiments, these are provided by way of example only and should not be construed as limiting the scope of the inventions disclosed herein.

Figure 1:
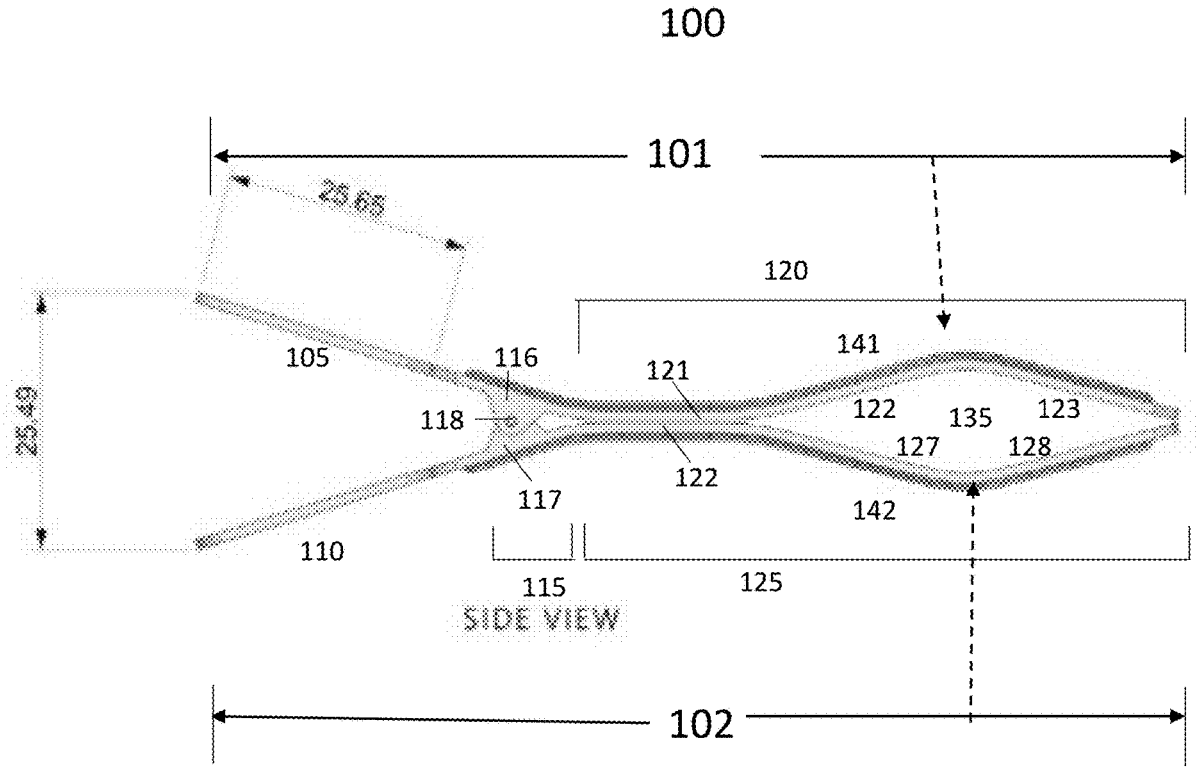
FIG. 1 illustrates a side view of a cigar holder according to some embodiments.

FIG. 1 illustrates a side view of a cigar holder according to some embodiments. In some embodiments, a novel cigar holder 100 includes a top handle 105, a bottom handle 110, a hinging assembly 115, a top gripping assembly 120 and a bottom gripping assembly 125. In some embodiments, a hinging assembly 115 includes a top hinging assembly 116, a bottom hinging assembly 117 and/or a pin 118. A cigar holder may also be referred to as a cigar clip. In some embodiments, a first piece of a novel cigar holder (e.g., a top piece 101) may include the top handle 105, a top hinging assembly 116 and a top gripping assembly 120. In some embodiments, a second piece (e.g., a bottom piece 102) may include the bottom handle 110, a bottom hinging assembly 117, and a bottom gripping assembly 125. In some embodiments, a pin 118 may connect and/or couple a top piece 101 and a bottom piece 102 to form the novel cigar holder 100.

In some embodiments, the top piece 101 may be one piece. In some embodiments, the bottom piece 102 may be one piece. In some embodiments, the top piece 101 and/or the bottom piece 102 may be made of a metal, a hardened plastic, a composite material or a combination thereof. In some embodiments, the top piece 101 may include the top handle assembly 105, a top hinging assembly 116, and/or a top gripping assembly 120. In some embodiments, a top plastic material or coating 141 may cover and/or be adhered to a top surface of the top hinging assembly 116 and/or a top surface of a top gripping assembly 120. In some embodiments, a bottom piece 102 of a cigar holder may include a bottom handle assembly 110, a bottom hinging assembly 117, and/or a bottom gripping assembly 125. In some embodiments, a bottom plastic material or coating 142 may cover and/or be adhered to a bottom surface of a bottom hinging assembly 116 and/or a bottom surface of a bottom gripping assembly 125. In some embodiments, a top plastic material or coating 141 and/or a bottom plastic material or coating 142 may be made of a heat resistant plastic or material. In some embodiments, the top plastic coating 140 and 141 may need to be flexible and allow movement of the hinging assembly 115, the top gripping assembly 120 and the bottom gripping assembly 125 when the cigar holder is opened or moved to an open position.

In some embodiments, a cigar smoker or user may grip the top handle or top handle assembly 105 and/or a bottom handle or bottom handle assembly 110, which may activate a hinging or spring assembly 115. In some embodiments, the activation of the hinging or spring assembly 115 may cause the top gripping assembly 120 to move up and away from the bottom gripping assembly 125, which will form an larger opening 135 into which a cigar may be inserted. This may be referred to as an open position (e.g., when the top handle 105 and the bottom handle 110 are pressed towards each other). In some embodiments, a force exerted on a top handle 105 and/or a bottom handle 110 may determine how large of an opening 135 may be formed. In a closed position or resting position, as illustrated by the drawing in FIG. 1, the top handle 105 is not pressed to the bottom handle 110 and thus the hinging or spring assembly 115 is not activated and/or utilized. Accordingly, portions of a top gripping assembly 120 (e.g., a distal end of a top gripping assembly 120) may be positioned or may be resting against portions of a bottom gripping assembly 125 (e.g., a distal end of a bottom gripping assembly 125). In this embodiments, an opening still exists between portions of the top gripping assembly 120 and a bottom gripping assembly 125, but the opening 135 is smaller than in the open position. In some embodiments, a distance formed by a top handle assembly 105 and a bottom handle assembly 110 when a cigar holding device 100 is in a closed or at rest position may be 25.5 millimeters and/or alternatively may range from 15 millimeters to 35 millimeters. In some embodiments, a length of a top handle assembly 105 and/or a bottom handle assembly 110 may be 25.65 millimeters and/or alternatively may range from 15 to 35 millimeters.

In some embodiments, the hinging assembly 115 may be a spring tensioned hinging assembly. In some embodiments, the hinging assembly 115 may include a pin 116 to hold a top portion 117 of the hinging assembly to a bottom portion 118 of the bottom assembly together (or to provide tension between the top hinging assembly 117 and the bottom hinging assembly 118). In some embodiments, the hinging assembly 115 may be made of a metal material, a plastic material, a composite material, or a combination thereof.

In some embodiments, a top surface of a handle assembly 105 and a bottom surface of a bottom handle assembly 110 may include a rubber or sticky substance in order to allow users to more easily grip the top handle assembly 105 and the bottom handle assembly 110.

In some embodiments, a shape of a top gripping assembly 120 and a bottom gripping assembly 125 may be novel and unique. In some embodiments, a top gripping assembly 120 may have a first section 121 which is horizontal or straight. In some embodiments, a second section 122 of a top gripping assembly 120 may rise 0 to 45 degrees vertically from the first section 121. In alternative embodiments, a second section 122 may rise 10 to 25 degrees from a first section 121. In some embodiments, a third section 123 of a top gripping section 120 may decrease or fall 0 to 45 degrees vertically from a second section 122 of a top gripping assembly 120, which results in a distal end of the top gripping assembly 120 to be positioned in a similar horizontal plane as the first section 121 of the top gripping assembly 120. In alternative embodiments, a third section 123 may rise 10 to 25 degrees vertically from a second section 122 of the top gripping assembly 120. In some embodiments, a shape of the top gripping assembly 120 may allow an opening 135 to be created to allow a cigar to be placed in between the top gripping assembly 120 and the bottom gripping assembly 125.

In some embodiments, a shape of bottom gripping assembly 125 may have a first section 126, a second section 127 and a third section 128. In some embodiments, the first section 126 may be horizontal or straight. In some embodiments, a second section may rise 0 to 45 degrees vertically from a first section. In alternative embodiments, a second section 127 of the bottom gripping assembly may decrease or fall 10 to 25 degrees vertically from a first section 126. In some embodiments, a third section 128 of the bottom gripping assembly may rise 0 to 45 degrees vertically from a second section 127. In alternative embodiments, a third section 128 may rise 10 to 25 degrees vertically from a second section 127. In some embodiments, a shape of a bottom gripping assembly 125 may be opposite to or a reverse of a top gripping assembly 120 to create the opening 135 for the cigar to be placed into.

In FIG. 1, the top piece 101 of the cigar holder may be one piece. In alternative embodiments, the top piece 101 may be comprised of multiple connected assemblies. In some embodiments, a distal end of the top handle assembly 105 and a distal end of the bottom handle assembly 110 may be inserted into one side of a top portion 116 of the hinging assembly and one side of a bottom portion 117 of the hinging assembly 115, respectfully. In some embodiments, a distal end of the handle assemblies 105 and 110 may be connected, welded, adhered or glued to one side of the respective top 116 and bottom 117 portion of the hinging assembly 115.

In some embodiments, a proximate end of a top gripping assembly 120 may be inserted into a second side of a top part 116 of the hinging assembly 115 and a proximate end of a bottom gripping assembly 125 may be inserted into a second side of a bottom part 117 of the hinging assembly 115. In some embodiments, the proximal ends of the gripping assemblies 120 125 may be connected, welded, adhered or glued to one side of the top 116 and bottom 117 portions of the hinging assembly.

Figure 2:
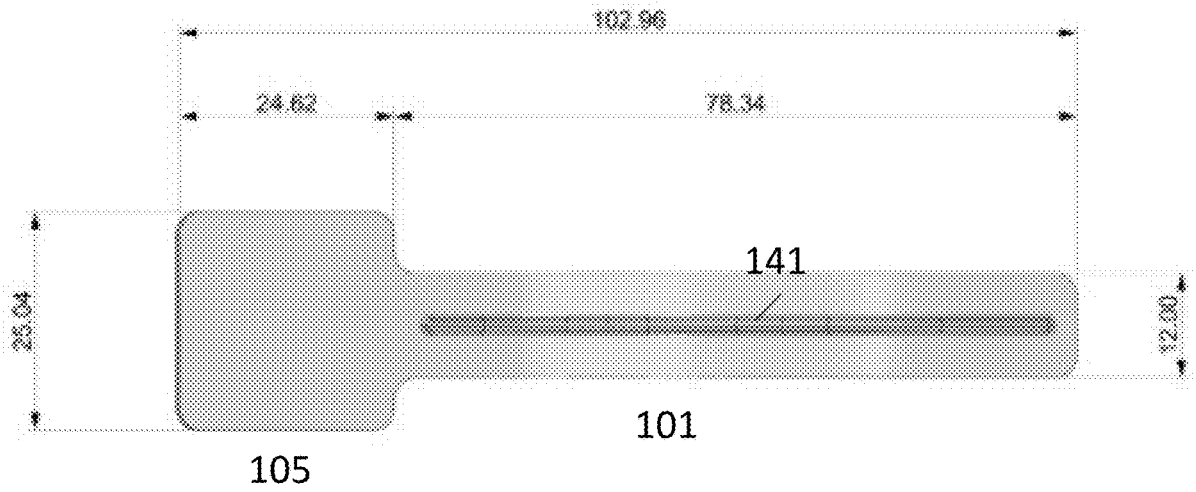
FIG. 2 illustrates a top view of a cigar holder according to some embodiments.
Figure 3:
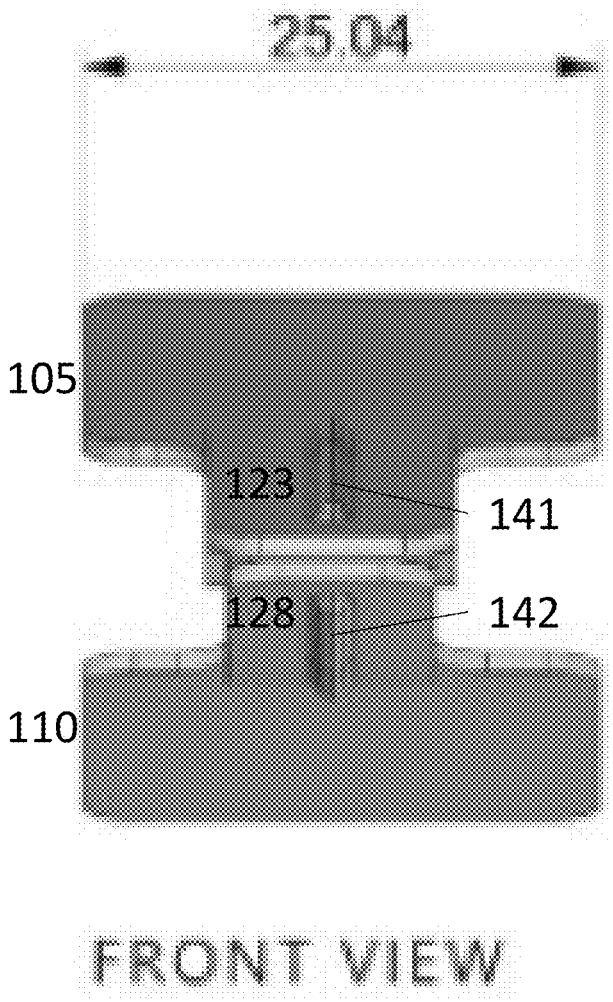
FIG. 3 illustrates a front view of a cigar holder according to some embodiments.

FIG. 2 illustrates a top view of a cigar holder according to some embodiments. FIG. 3 illustrates a front view of a cigar holder according to some embodiments. In FIG. 2, the cigar holder 100 may include a top view of the top handle assembly 105, a top piece 101 and/or a plastic coating or covering 141. In some embodiments, a top handle assembly 105 may have a length of 25.04 millimeters and/or a width of 25.04 millimeters (e.g., it may be a square). In other embodiments, a top handle assembly 105 may have a length ranging from 15 to 35 millimeters and/or a width ranging from 15 to 35 millimeters. In other embodiments, a top handle assembly 105 may not have a square shape. In some embodiments, a bottom handle assembly 110 may have similar dimensions. In some embodiments, a top piece 101 may have a length of 102.96 millimeters. In some embodiments, a top piece 101 may have a length ranging from 80 to 125 millimeters. In some embodiments, a bottom piece 102 may have similar length requirements. In some embodiments, a width of a remainder of the top piece 101 or bottom piece 102 (e.g., not the handle assembly) may be 12 millimeters or may have a width ranting from 8 to 16 millimeters. FIG. 3 illustrates how a top piece 101 and a bottom piece 102 are viewed from a front. The front view illustrates a top handle assembly 105, a top plastic coating or material 141, a third section 123 of a top gripping assembly 120, a third section 128 of a bottom gripping assembly 125, and/or a bottom handle assembly 110.

The description above allows a user to securely grip and hold a cigar. In addition, this allows a user to enjoy a cigar down to is end without coming close to (and potentially burning) a user's fingers. The design and description above allows the user to hold a cigar naturally. The description above allows a user to hold a variety of cigar gauges and/or sizes. The design and description above prevents a user from having a smokey hold odor on its fingers. The cigar holder is adjustable because a user determines how hard to press the top handle assembly 105 to the bottom assembly 110.

Figure 4:
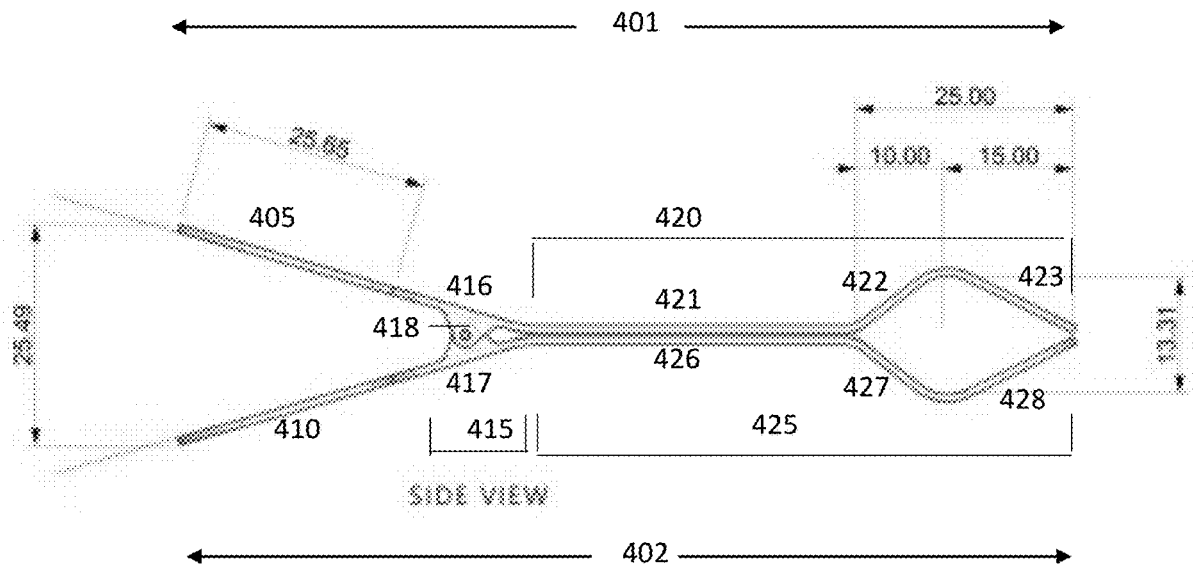
FIG. 4 illustrates a side view of a cigar holder according to an alternative embodiment.

FIG. 4 illustrates a side view of a cigar holder according to an alternative embodiment. In this embodiment, a novel cigar holder includes a top handle 405, a bottom handle 410, a hinging assembly 415, a top gripping assembly 420 and/or a bottom gripping assembly 425. In this embodiment, a hinging assembly 415 includes a top hinging assembly 416, a bottom hinging assembly 417 and a pin 418. In this embodiment, a first piece of a novel cigar holder (e.g., a top piece 401) may include the top handle 405, a top hinging assembly 416 and a top gripping assembly 420. In this embodiment, a second piece (e.g., a bottom piece 402) of a novel cigar holder may include the bottom handle 410, a bottom hinging assembly 417, and a bottom gripping assembly 425. In this embodiment, a pin 418 may connect and/or couple a top piece 401 and a bottom piece 402 to form the novel cigar holder 400.

In this embodiment, the top piece 401 and the bottom piece 402 may be one piece. In this embodiment, the top piece 401 and the bottom piece 402 may be made of a metal, a hardened plastic, a composite material or a combination thereof. In some embodiments, a top handle 405 or a bottom handle 410 may be engraved with a logo or a name of a company that is promoting and/or marketing the novel cigar holder. This is also true with respect to the top handle 105 and bottom handle 110 in FIGS. 1-3.

In this embodiment, a cigar smoker or user may grip the top handle 405 and/or a bottom handle 410, which may activate a hinging or spring assembly 415. In this embodiment, the activation of the hinging or spring assembly 415 may cause the top gripping assembly 420 to move up and away from the bottom gripping assembly 425, which will form a larger opening 435 into which a cigar may be inserted. This may be referred to as an open position (e.g., when the top handle 405 and the bottom handle 410 are pressed towards each other). In this embodiment, a force exerted on a top handle 405 and/or a bottom handle 410 may determine how large of an opening 435 may be formed. The size of the opening 435 may be adjustable to different sizes or gauges of cigars. In a closed position or resting position, as illustrated by the drawing in FIG. 4, the top handle 405 may not be pressed to the bottom handle 410 and thus the hinging or spring assembly 415 may not be activated and/or utilized. Accordingly, portions of a top gripping assembly 420 (e.g., a distal end 431 of a top gripping assembly 420) may be positioned or may be resting against portions of a bottom gripping assembly 425 (e.g., a distal end 432 of a bottom gripping assembly 425). In this embodiment, an opening 435 still exists between portions of the top gripping assembly 420 and a bottom gripping assembly 425, but the opening 435 is smaller than in the open position. In this embodiment, a distance formed by a top handle assembly 405 and a bottom handle assembly 410 when a cigar holding device 400 is in a closed or at rest position may be 25.5 millimeters, or alternatively may range from 15 millimeters to 35 millimeters. In this embodiment, a length of a top handle assembly 405 and/or a bottom handle assembly 410 may be 25.65 millimeters, or alternatively may range from 15 to 35 millimeters.

In this embodiment, the hinging assembly 415 may be a spring-tensioned hinging assembly. In this embodiment, the hinging assembly 415 may include a pin 418 to hold a top portion 416 of the hinging assembly to a bottom portion 417 together (and/or to provide tension between the top hinging assembly 416 and the bottom hinging assembly 417). In this embodiment, the hinging assembly 415 may be made of a metal material, a plastic material, a composite material, or a combination thereof.

In this embodiment, a top surface of a handle assembly 405 and a bottom surface of a bottom handle assembly 410 may include a rubber or sticky substance in order to allow users to more easily grip the top handle assembly 405 and the bottom handle assembly 410.

In this embodiment, a shape and length of the top gripping assembly 420 and a bottom gripping assembly 425 (or portions thereof) are different from the embodiments shown in FIGS. 1-3. The embodiment illustrated and shown in FIGS. 4-6 may allow a user's hand to be further away from a lit cigar and the associated fire. This is due to extra length in a middle section 421 of the top gripping assembly 420 and a middle section 426 of the bottom gripping assembly 425. In this embodiment, the middle sections 421 and 426 may be 53.34 millimeters, or alternatively may range from 40 to 65 millimeters. In this embodiment, this creates a shorter second section 422 and third section 423 for the top gripping assembly 420 and a shorter second section 427 and third section 428 for the bottom gripping assembly 425. In this embodiment, a shape of a top gripping assembly 420 and a bottom gripping assembly 425 may be novel and unique. In this embodiments, a top gripping assembly 420 may have a first section 421 which is horizontal or straight. The FIG. 4 embodiment first sections 421 422 are significantly longer than the FIG. 1 first sections 121 122. In this embodiment, a second section 422 of a top gripping assembly 420 may rise 0 to 60 degrees vertically from the first section 421. In alternative embodiments of the FIG. 4 design, a second section 422 may rise 35 to 55 degrees from a first section 421. In this embodiment, a third section 423 of a top gripping assembly 520 may decrease or fall 0 to 60 degrees vertically from a second section 422 of a top gripping assembly 420, which results in a distal end 431 of the top gripping assembly 420 to be positioned in a similar horizontal plane as the first section 421 of the top gripping assembly. In alternative embodiments of the FIG. 4 design, a third section 423 may decrease or fall 30 to 50 degrees vertically from a second section 422 of the top gripping assembly 420. In this embodiment, a shape of the top gripping assembly 420 may allow an opening 435 to be created to allow a cigar to be placed in between the top gripping assembly 420 and the bottom gripping assembly 425.

In this embodiment, a shape of bottom gripping assembly 425 may have a first section 426, a second section 427 and a third section 428. In this embodiment, the first section 426 may be horizontal or straight, as is illustrated in FIG. 4. In this embodiment, a second section 427 may fall or decrease 0 to 60 degrees vertically from a first section 426. In this embodiment, a second section 427 may decrease or fall 30 to 50 degrees vertically from a first section 426. In some embodiments, a third section 428 may rise 0 to 60 degrees vertically from a second section 427. In alternative embodiments, a third section 428 of the bottom gripping assembly 425 may rise 35 to 55 degrees vertically from a second section 427. In this embodiment, a shape of a bottom gripping assembly 425 may be opposite to or a reverse of a top gripping assembly 420 to create the opening 435 for the cigar to be placed into. In this embodiment, a second section 422 of the top gripping assembly 420 and a second section 427 of the bottom gripping assembly 425 may have a length of 10.00 millimeters. In alternative embodiments, a second section 422 of the top gripping assembly 420 and a second section 427 of the bottom gripping assembly 425 may have a length ranging from 4 millimeters to 16 millimeters. In this embodiment, a third section 423 of the top gripping assembly 420 and a third section 428 of the bottom gripping assembly 425 may have a length of 15.00 millimeters. In other embodiments, a third section 423 of the top gripping assembly 420 and a third section 428 of the bottom gripping assembly 425 may have a length ranging from 10 to 20 millimeters.

In FIG. 4, the top piece 401 of the cigar holder 400 may be one piece. In FIG. 4, the bottom piece 402 of the cigar holder 400 may be one piece. In alternative embodiments, the top piece 401 and the bottom piece 402 may be comprised of multiple connected assemblies.

In some embodiments, a shell or a designed body (e.g., like a shark, a grizzly bear, or a hawk or a bird with a beak) may cover portions of the top piece 401 or 101 of the cigar holder and/or may cover portions of the bottom piece 402 or 102 of the cigar holder. As an illustrative example, a top part of a shell or designed body may cover the top hinging assembly 116 416 and/or the top gripping assembly 120 420 and a bottom part of a shell or designed body may cover the bottom hinging 117 417 and/or the bottom gripping assembly 125 425 so that a mouth of the designed body (e.g., a mouth of a shark, a grizzly bear, or hawk) may open. The top part of a shell or designed boy may be connected or coupled to the bottom part of a shell or designed body via a pin (which may or may not be the same pin 118 or 418 utilized in the embodiments in FIGS. 1 and 4. This allows various pleasing designs to be established for a cigar holder.

Figure 5:
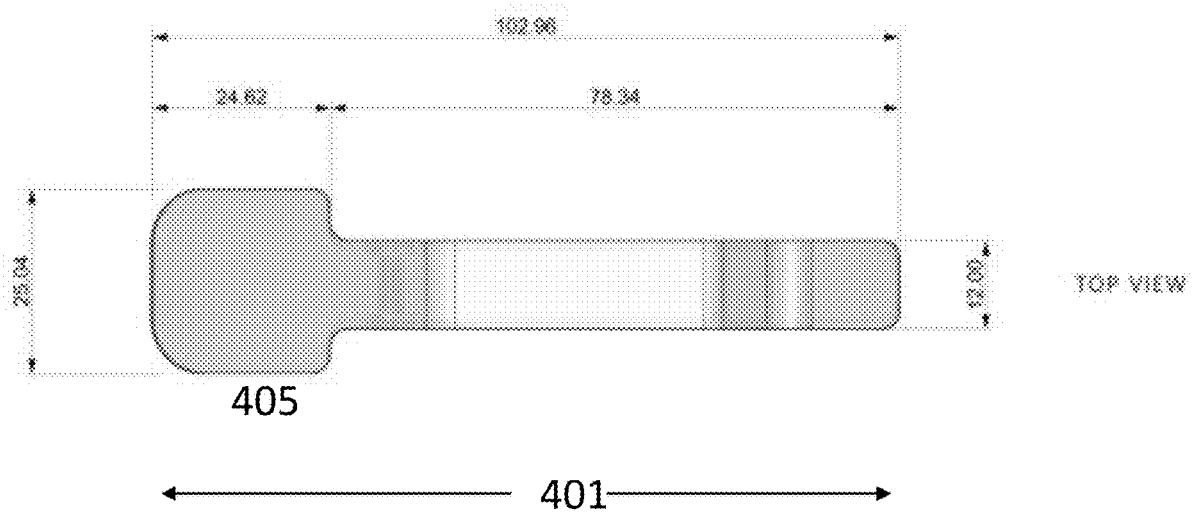
FIG. 5 illustrates a side view of a cigar holder according to an alternative embodiment.

FIG. 5 illustrates a top view of a cigar holder according to some embodiments. FIG. 5 illustrates a front view of a cigar holder according to some embodiments. In FIG. 5, the cigar holder 400 includes a top view of the top handle assembly 405 and/or a top piece 401. In this embodiment, a top handle assembly 405 or a bottom handle assembly 410 may have a length of 25.04 millimeters and/or a width of 25.04 millimeters (e.g., it may be a square). In other embodiments, a top handle assembly 405 or a bottom handle assembly 410 may have a length ranging from 15 to 35 millimeters and/or a width ranging from 15 to 35 millimeters. In other embodiments, a top handle assembly 405 and a bottom handle assembly 410 may have a square shape and in alternative embodiments, a top handle assembly 405 and a bottom handle assembly 410 may not have a square shape.

In this embodiment, a top piece 401 or a bottom piece 402 may have a length of 102.96 millimeters. In other embodiments, a top piece 401 or a bottom piece 402 may have a length ranging from 80 to 125 millimeters. In some embodiments, a width of a remainder of the top piece 401 or bottom piece 402 (e.g., not the handle assembly) may be 12 millimeters or may have a width ranting from 8 to 16 millimeters.

Figure 6:
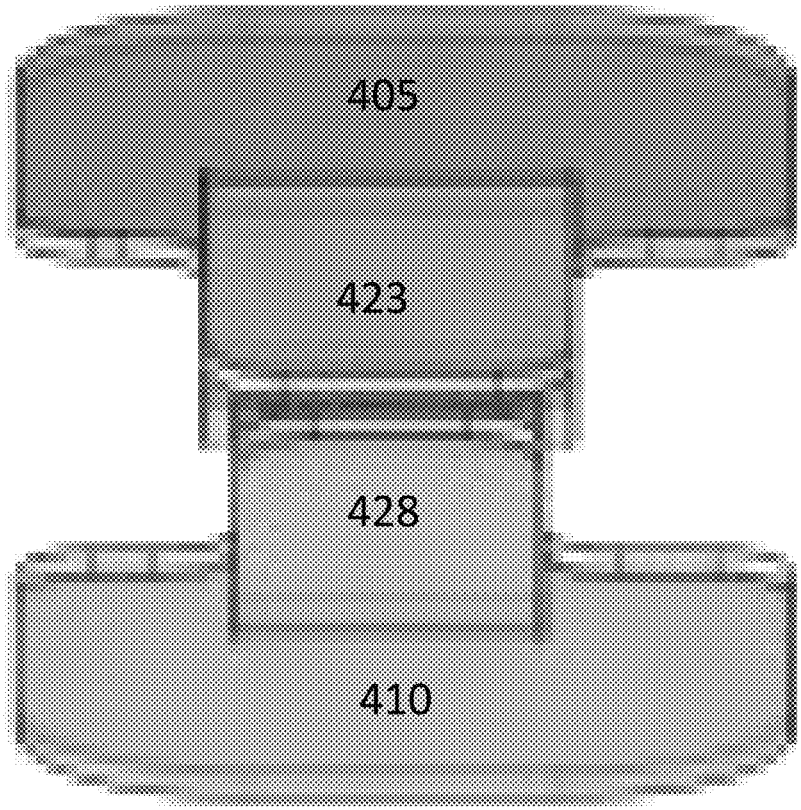
FIG. 6 illustrates a side view of a cigar holder according to an alternative embodiment.

FIG. 6 illustrates how a top piece 401 and a bottom piece 402 are viewed from a front. The front view in FIG. 6 illustrates a top handle assembly 405, a third section 423 of a top gripping assembly 420, a third section 428 of a bottom gripping assembly 425, and/or a bottom handle assembly 410.

Figure 7:
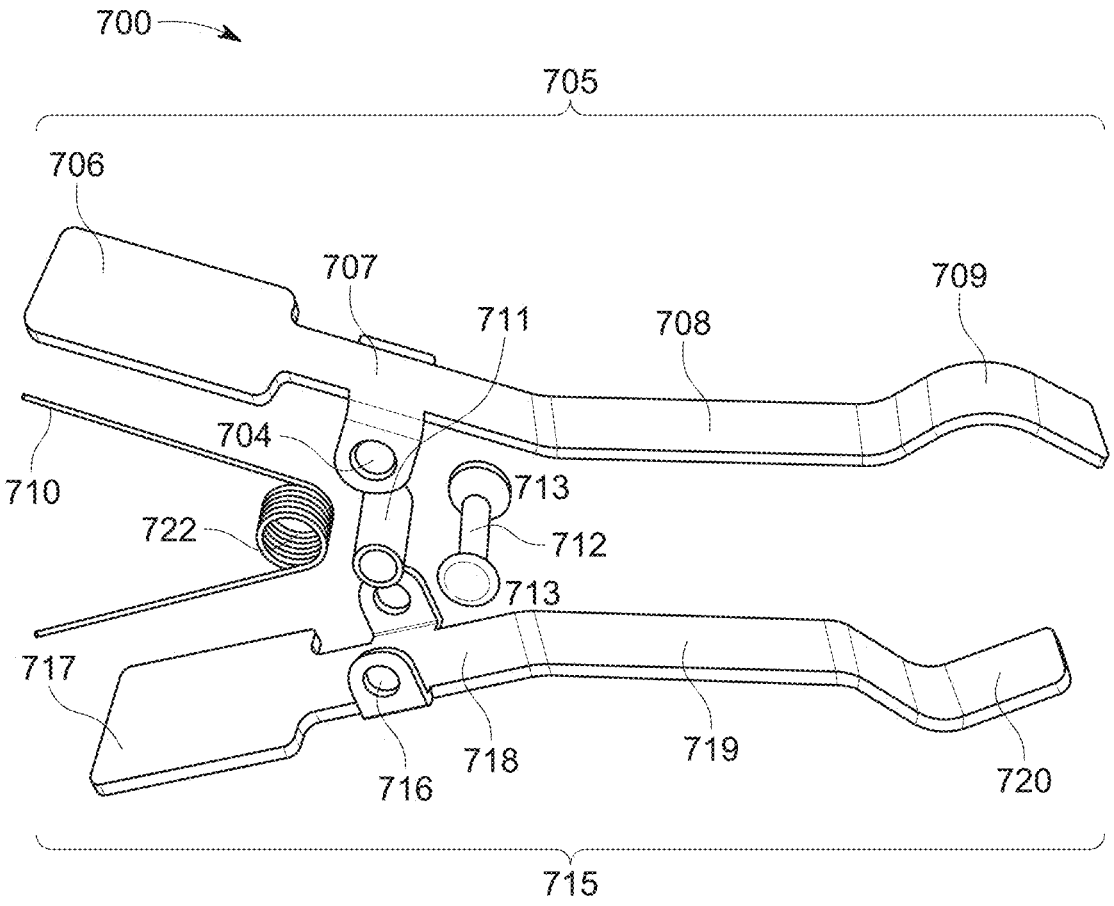
FIG. 7 illustrates a landscape exploded view another cigar (or smoking article) holder according to exemplary embodiments.
Figure 8:
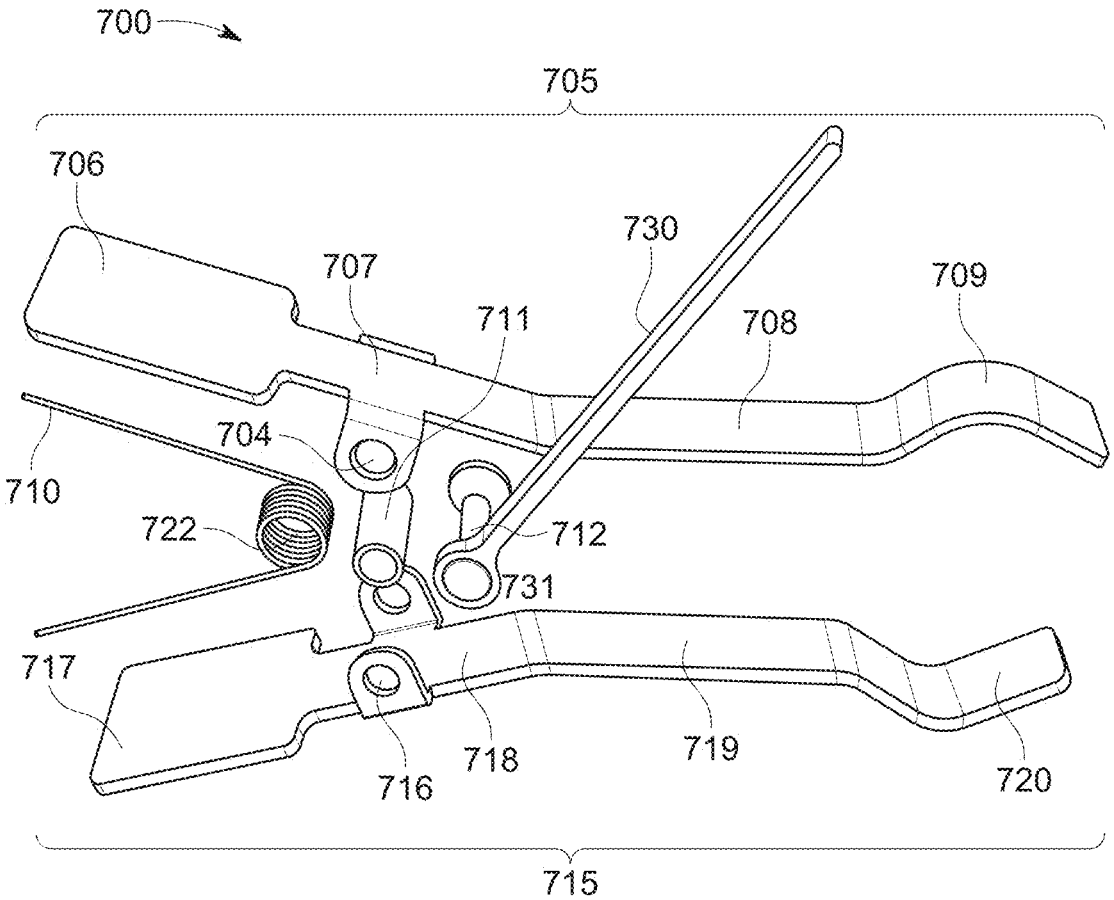
FIG. 8 illustrates a landscape exploded view of a smoking article holder including a pick according to some embodiments.

FIG. 7 or FIG. 7 illustrates a landscape exploded view another cigar (or smoking article) holder according to exemplary embodiments. FIG. 8 or FIG. 8 illustrates a landscape exploded view of a smoking article holder including a pick or pick assembly according to some embodiments. FIG. 7 illustrates a cigar holder 700. In exemplary embodiments, a cigar holder 700 includes a top jaw assembly 705, a bottom jaw assembly 715, a spring 710, a spacer element 711 and/or a rivet or connector 712. In exemplary embodiments, a top jaw assembly 705 may include a hand or finger gripping area 706, an angled section 707 including two holes or openings 704, a flat section 708, and/or a curved portion or cigar gripping portion 709. In exemplary embodiments, a bottom jaw assembly 715 may include a hand or finger gripping area 717, an angled section 718 including two holes or openings 716, a flat section 719, and/or a curved portion or cigar gripping portion 720. In exemplary embodiments, a top jaw assembly 705 may be coupled and/or attached to a bottom jaw assembly 715 by a rivet or connector 712. In exemplary embodiments, a top jaw assembly 705 may be placed on top of a bottom jaw assembly 715 where the openings 704 of the top jaw assembly 705 may be aligned with the openings 716 of the bottom jaw assembly 715. In some implementations, the openings 704 of the top jaw assembly and the openings 716 of the bottom jaw assembly may be aligned with an opening in a spacer 711. In some implementations, a space 711 may have a hollow opening or hollow center. In some implementations, this opening may allow the rivet or connector 712 to pass through the hollow opening of the spacer 711, and the openings 704 and 716 to connect the top jaw assembly 705 to the bottom jaw assembly 715.

In exemplary embodiments, a spring 710 may include an opening 722. In exemplary embodiments, the one or more spacers 711 may be placed into the opening 722 of the spring 710 and may provide support for the spring 710 (keep a shape of a spring and minimize or prevent inward sagging). In exemplary embodiments, one or more spacers 711 may be placed and/or aligned with the top openings 704 of the top jaw assembly and bottom openings 716 of the bottom jaw assembly. In some implementations, the one or more spacers 711 may be hollow in a center portion. In exemplary embodiments, in order to hold the top jaw assembly 705, the bottom jaw assembly 715, the spring 710 and the one or more spacers 711 in place, one or rivets or connectors 712 may be inserted into a hollow center of the one or more spacers 711. In some implementations, the one or more rivets or connectors 712 may have a diameter or width of one dimension in a middle portion and a larger diameter or width at both end portions 713. In this implementation, the middle section may fit into the hollow section of the one or more spacers 711, whereas the ends 713 of the rivet or connector 712 may not fit through the hollow section of the one or more spacers 711. In some implementations, one of the ends 713 of the rivet or connectors 712 may be detachable from a middle portion of the rivet or connector. In some implementations, the detachability may occur utilizing a snap fit, a screw and thread, or a welding of the end 713 of the rivet to middle section of the rivet or connector 712.

In exemplary embodiments, the hand or finger gripping area or section 706 may be positioned from 0 to 60 degrees from a horizontal axis, as is illustrated in FIG. 7. In exemplary embodiments, the hand or finger gripping area or section 706 may be positioned from approximately 10 to 20 degrees, or alternatively approximately 15 to 17 degrees from a horizontal axis. In exemplary embodiments, an angled section 707 including two holes or openings 704 may be positioned from 0 to 60 degrees vertically from a horizontal axis and may be positioned in a similar angular orientation to the hand or finger gripping area or section 706. In exemplary embodiments, an angled section 707 may be positioned from approximately 10 to 20 degrees, or alternatively approximately 15 to 17 degrees from a horizontal axis. This positioning along with a tension of the spring 710 and corresponding sections of the bottom jaw assembly 715 may allow a user of the cigar holder 700 to press on these sections to open the cigar holder in order to grip or hold a cigar.

In exemplary embodiments, as shown in FIG. 7, a flat section 708 may be in substantially a horizontal plane. In some implementations, the flat section 708 may be positioned from 0 to 2 degrees with respect to a horizontal axis. In exemplary embodiments, a curved portion 709 of the top jaw assembly may have three sections, a first section, a second section and a third section. In some implementations, a first section may rise from a horizontal axis, a second section may be curved and a third section may fall with respect to a horizontal axis. This shape allows a cigar or smoking article to be held between the curved portion 709 of the upper jaw assembly and a curved portion 720 of the bottom jaw assembly.

In exemplary embodiments, the hand or finger gripping area or section 717 of a bottom jaw assembly may be positioned from 0 to 60 degrees from a horizontal axis, as is illustrated in FIG. 7, however in an opposite direction from the gripping area 706 of the top jaw assembly. In alternative embodiments, the hand or finger gripping area or section 717 of a bottom jaw assembly may be positioned from approximately 10 to 20 degrees, or alternatively approximately 15 to 17 degrees from a horizontal axis. As illustrated in FIG. 7, the hand or finger gripping area or section 717 of the bottom jaw assembly 715 may be positioned in an opposite direction a position of the finger gripping area or section 706 of the top jaw assembly 705. In exemplary embodiments, an angled section 718 including two holes or openings 716 may be positioned from 0 to 60 degrees vertically from a horizontal axis and may be positioned in a similar angular orientation to the hand or finger gripping area or section 717. In alternative embodiments, an angled section 718 may be positioned from approximately 10 to 20 degrees, or alternatively approximately 15 to 17 degrees from a horizontal axis. This positioning along with a tension of the spring 710, the spacer 711, the rivet or connector 712 and corresponding sections of the top jaw assembly 705 may allow a user of the cigar holder 700 to press on these sections to open the cigar holder in order to grip or hold a cigar. In exemplary embodiments, as shown in FIG. 7, a flat section 719 may be in substantially a horizontal plane. In some implementations, the flat section 719 may be positioned from 0 to 2 degrees with respect to a horizontal axis. In exemplary embodiments, the flat section 719 of the bottom jaw assembly 715 may be touching and/or parallel to the flat section 708 of the top jaw assembly 705. In exemplary embodiments, a curved portion 720 of the bottom jaw assembly 715 may have three sections, where a first section falls from a horizontal axis, a second section is curved downwards and a third section rises with respect to a horizontal axis. In some implementations, the curved portion 720 of a bottom jaw assembly may be opposite in positioning or orientation to a curved portion 709 of the top jaw assembly 705. In exemplary embodiments, a shape of the curved portion 720 of the bottom jaw assembly 715 may allow a cigar or a smoking article to be held or gripped by the cigar holder 700.

In exemplary embodiments, a hand or finger gripping area or section 706 of a top jaw assembly 705 and/or a hand or finger gripping area or section 717 of a bottom jaw assembly 715 may have a length of approximately 25 millimeters and/or a width of 25 millimeters (e.g., it may be a square or close to a square in shape). In alternative embodiments, a hand or finger gripping area or section 706 of top jaw assembly 705 and/or a hand or finger gripping area or section 717 of a bottom jaw assembly 715 may have a length ranging from 15 to 35 millimeters and/or a width ranging from 15 to 35 millimeters. In other embodiments, a hand or finger gripping area or section 706 of top jaw assembly 705 and/or a hand or finger gripping area or section 717 of bottom jaw assembly 715 may have a square shape and in alternative embodiments, a hand or finger gripping area or section 706 of top jaw assembly 705 and/or a hand or finger gripping area or section 717 of bottom jaw assembly 715 may not have a square shape.

In exemplary embodiments, a top jaw assembly 705 and/or a bottom jaw assembly 715 may have a length of approximately 114 to 116 millimeters. In alternative embodiments, a top jaw assembly 705 and/or a bottom jaw assembly 715 may have a length ranging from 80 to 125 millimeters. In exemplary embodiments, a width of a remainder a top jaw assembly 705 and/or a bottom jaw assembly 715 (e.g., not the hand or finger gripping areas 706 or 717) may be approximately 12 millimeters wide. Alternatively, a width of a remainder a top jaw assembly 705 and/or a bottom jaw assembly 715 (e.g., not the hand or finger gripping areas 706 or 717) may have a width ranting from 8 to 16 millimeters.

In exemplary embodiments, a configuration of the cigar holder allows the cigar holder 700 to rest on a surface by placing the bottom jaw assembly 715 on a horizontal surface. In addition, the cigar holder 700 may rest on a surface by placing the top jaw assembly 705 and a bottom jaw assembly 715 on a surface in a horizontal position. In exemplary embodiments, the cigar holder 700 has a same position at rest as when the cigar holder 700 has a cigar clasped in between the top jaw assembly curved area 709 and the bottom jaw assembly curved area 720. In some embodiments, the cigar holder 700 may be able to stand vertically by placing the cigar holder in a vertically oriented position where a hand or finger gripping area or section 706 of a top jaw assembly 705 and a hand or finger gripping area or section 717 of a bottom jaw assembly 715 are placed on an end (e.g., a distal end from the curved areas 709 and 720).

FIG. or FIG. 8 includes an additional component that has been added to the cigar holder which is a pick or pick assembly 730. In exemplary embodiments, the pick or pick assembly 730 may be utilized by a cigar holder user in order to puncture holes in either end of the cigar to increase a draw on the cigar from the user. In other words, the pick or pick assembly 730 may be a penetrating tool. In some implementations, the pick or pick assembly 730 may be used on either end of the cigar to make a hole in or puncture the tobacco in the cigar, thus making it easier to smoke. In exemplary embodiments, in FIG. 8, the pick or pick assembly 730 may be connected to the cigar holder because it has an opening 731 on one end. The cigar may be placed on a second and opposite end of the pick or pick assembly 730. In some implementations, a rivet or connector 712 would be placed through an opening 731 of the pick or pick assembly 730 and then a detachable end 713 of the rivet or connector 712 may be connected to hold the pick or pick assembly 730 in place. In exemplary embodiments, the pick or pick assembly 730 may be able to rotate 180 degrees. In alternative embodiments, the pick or pick assembly 730 may be rotatable up to 360 degrees.

In some embodiments, portions and/or sections of the cigar holder described in FIGS. 7 and 8 may have similar dimensions and/or sizes as those described in FIGS. 1-6. In some embodiments, the cigar holder 700 may be made of a stainless steel material. In some embodiments, the cigar holder 700 may be made of a metal material, a plastic material, a composite material, a wood material, a synthetic material or a combination of these materials.

In exemplary embodiments, a cigar holder may include a top jaw assembly, the top jaw assembly including first opening on a first side and a second opening on a second side; a bottom jaw assembly, the bottom jaw assembly including a first opening on a first side and a second opening on a second side; a spring; a spacer element, the spacer element including a hollow center and the spacer element placed inside an opening in a center of a spring and positioned adjacent the first opening and the second opening of the top jaw assembly and positioned adjacent the first opening and the second opening of the bottom jaw assembly; and a rivet, the rivet including a main body, a fixed first end and a detachable second end, the rivet configured to be positioned in the hollow opening of the spacer element and through the first opening and the second opening of the top jaw assembly and through the first opening and the second opening of the bottom assembly, wherein the fixed first end and the detachable second end of the rivet including a larger diameter than the hollow opening of the spacer element, the first opening and the second opening of the top jaw assembly, and the first opening and the second opening of the bottom jaw assembly, and wherein the detachable second end of the rivet is configured to be connected to the main body of the rivet to couple the top jaw assembly to the bottom jaw assembly.

In exemplary embodiments, a pick assembly, the pick assembly may puncture a cigar at one end or the other end in order to make the cigar easier to smoke. In some implementations, the pick assembly may be rotatable by 180 degrees, or alternatively may be rotatable by 180 degrees. In some implementations, the pick assembly may have an opening and a pick body, and the rivet is positioned through the pick assembly opening to connect the pick assembly to the cigar holder. In exemplary embodiments, the top jaw assembly may include a first gripping area, a first angled section, a first flat section and a first curved cigar gripping section; and the bottom jaw assembly including a second gripping area, a second angled section, a second flat section and a second curved cigar gripping section, where the first gripping area, the first angled section and the first curved cigar gripping section are positioned in an opposite direction with respect to the second gripping area, the second angled section, and the second curved cigar gripping section to cause the cigar to be held in between the first curved cigar gripping section and the second curved cigar gripping section. In exemplary embodiments, the first flat section may be parallel with respect to a second flat section. In exemplary embodiments, the first gripping area may be pushed toward the second gripping area to cause an opening between the first curved cigar gripping section and the second curved cigar gripping section to open and to allow a cigar to be placed between the first curved cigar gripping section and the second curved cigar gripping section.

In exemplary embodiments, a user may place an end of the first gripping area of the top jaw assembly and an end of the second gripping area of the bottom jaw assembly to allow the cigar holder to stand in a vertical direction. In exemplary embodiments, the top jaw assembly may be placed in a horizontal orientation, the first gripping area and the first angled section may be positioned between 10 to 20 degrees with respect to a horizontal axis. In exemplary embodiments, the bottom jaw assembly may be placed in a horizontal orientation, the second gripping area and the second angled section may be positioned between 10 to 20 degrees with respect to a horizontal axis.

In exemplary embodiments, the first curved cigar gripping section has a first section rising from a horizontal axis, a second section having a curved shape and a third section falling with respect to the horizontal axis. In exemplary embodiments, the second curved cigar gripping section has a first section falling with respect to a horizontal axis, a second section having a curved shape, and a third section rising with respect to the horizontal axis.

A person of ordinary skill in the art will recognize that any process or method disclosed herein can be modified in many ways. The process parameters and sequence of the steps described and/or illustrated herein are given by way of example only and can be varied as desired. For example, while the steps illustrated and/or described herein may be shown or discussed in a particular order, these steps do not necessarily need to be performed in the order illustrated or discussed.

The various exemplary methods described and/or illustrated herein may also omit one or more of the steps described or illustrated herein or comprise additional steps in addition to those disclosed. Further, a step of any method as disclosed herein can be combined with any one or more steps of any other method as disclosed herein.

Unless otherwise noted, the terms "connected to" and "coupled to" (and their derivatives), as used in the specification and claims, are to be construed as permitting both direct and indirect (i.e., via other elements or components) connection. In addition, the terms "a" or "an," as used in the specification and claims, are to be construed as meaning "at least one of." Finally, for ease of use, the terms "including" and "having" (and their derivatives), as used in the specification and claims, are interchangeable with and shall have the same meaning as the word "comprising.

The processor as disclosed herein can be configured with instructions to perform any one or more steps of any method as disclosed herein.

As used herein, the term "or" is used inclusively to refer items in the alternative and in combination.

As used herein, characters such as numerals refer to like elements.

Embodiments of the present disclosure have been shown and described as set forth herein and are provided by way of example only. One of ordinary skill in the art will recognize numerous adaptations, changes, variations and substitutions without departing from the scope of the present disclosure. Several alternatives and combinations of the embodiments disclosed herein may be utilized without departing from the scope of the present disclosure and the inventions disclosed herein. Therefore, the scope of the presently disclosed inventions shall be defined solely by the scope of the appended claims and the equivalents thereof.

What is claimed is:

1. A cigar holder, comprising:

a top jaw assembly, the top jaw assembly including first opening on a first side and a second opening on a second side;

a bottom jaw assembly, the bottom jaw assembly including a first opening on a first side and a second opening on a second side;

a spring;

a spacer element, the spacer element including a hollow center and the spacer element placed inside an opening in a center of a spring and positioned adjacent the first opening and the second opening of the top jaw assembly and positioned adjacent the first opening and the second opening of the bottom jaw assembly;

a rivet, the rivet including a main body, a fixed first end and a detachable second end, the rivet configured to be positioned in the hollow opening of the spacer element and through the first opening and the second opening of the top jaw assembly and through the first opening and the second opening of the bottom assembly, wherein the fixed first end and the detachable second end of the rivet including a larger diameter than the hollow opening of the spacer element, the first opening and the second opening of the top jaw assembly, and the first opening and the second opening of the bottom jaw assembly, and wherein the detachable second end of the rivet is configured to be connected to the main body of the rivet to couple the top jaw assembly to the bottom jaw assembly; and further comprising a pick assembly, the pick assembly to puncture a cigar at one end or the other end in order to make the cigar easier to smoke, wherein the pick assembly has an opening and a pick body, and the rivet is positioned through the pick assembly opening to connect the pick assembly to the cigar holder.

2. The cigar holder of claim 1, wherein the top jaw assembly including a first gripping area, a first angled section, a first flat section and a first curved cigar gripping section; and the bottom jaw assembly including a second gripping area, a second angled section, a second flat section and a second curved cigar gripping section, where the first gripping area, the first angled section and the first curved cigar gripping section are positioned in an opposite direction with respect to the second gripping area, the second angled section, and the second curved cigar gripping section to cause the cigar to be held in between the first curved cigar gripping section and the second curved cigar gripping section.

3. The cigar holder of claim 2, wherein when the bottom jaw assembly is placed in a horizontal orientation, the second gripping area and the second angled section may be positioned between 10 to 20 degrees with respect to a horizontal axis.

4. The cigar holder of claim 2, wherein a user can place an end of the first gripping area of the top jaw assembly and an end of the second gripping area of the bottom jaw assembly on a flat surface to allow the cigar holder to stand in a vertical direction.

5. The cigar holder of claim 2, the first gripping area and the first angled section may be positioned between 10 to 20 degrees with respect to a horizontal axis.

6. The cigar holder of claim 2, wherein the first curved cigar gripping section has a first section rising from a horizontal axis, a second section having a curved shape and a third section falling with respect to the horizontal axis.

7. The cigar holder of claim 2, wherein the second curved cigar gripping section has a first section falling with respect to a horizontal axis, a second section having a curved shape, and a third section rising with respect to the horizontal axis.

8. The cigar holder of claim 1, wherein the pick assembly is rotatable by 180 degrees, or alternatively is rotatable up to 360 degrees.

9. The cigar holder of claim 2, wherein the first flat section is parallel with respect to the second flat section.

* * * * *